US005898381A

United States Patent [19]

Gartner et al.

[11] Patent Number: 5,898,381

[45] Date of Patent: Apr. 27, 1999

[54] LED TRAFFIC LIGHT AND METHOD OF MANUFACTURE AND USE THEREOF

[75] Inventors: William J. Gartner, Scottsdale, Ariz.; Christopher R. Myers, Basalt, Colo.

[73] Assignee: Traffic Technology, Inc., Scottsdale, Ariz.

[21] Appl. No.: 08/877,526

[22] Filed: Jun. 17, 1997

Related U.S. Application Data

[60] Provisional application No. 60/020,098, Jun. 19, 1996.

[51] Int. Cl.[6] ..... G08G 1/095

[52] U.S. Cl. ..... 340/815.65; 340/907; 340/815.45; 362/231

[58] Field of Search ..... 340/907, 908, 340/925, 944, 981, 982, 815.45, 815.65, 815.69; 362/231 R, 234, 252

[56] References Cited

U.S. PATENT DOCUMENTS

| | | | |
|---|---|---|---|
| 3,983,532 | 9/1976 | Hayes | 340/907 |
| 4,839,647 | 6/1989 | Patterson | 340/907 |
| 4,857,920 | 8/1989 | Kataoka et al. | 340/907 |
| 5,136,287 | 8/1992 | Borenstein | 340/907 |

OTHER PUBLICATIONS

*Tech Update*, "LED Traffic Lights", by Chris Calwell Nov. 1995, pp. 0–16, published in Boulder, Colorado.

*E Source*, Chapter 13 "Special Applications: LED Traffic Lights" 1994, sections 13.1–13.2, published in Boulder, Colorado.

*Primary Examiner*—Daniel J. Wu
*Attorney, Agent, or Firm*—Steven Lin

[57] ABSTRACT

LED traffic light 30 having a housing 39 that holds at least three different signal lights 32, 34, and 36. The three lights 32, 34, and 36 are each embedded in an opening 50 of housing 39. The LEDs for traffic signal lights 32, 34, and 36 are arranged in symbolic shapes (i.e. universal symbols or words) that further represent one of the traffic signals. Red signal light 32 has red LEDs 31 arranged in an octagon shape (i.e. stop sign shape), and yellow or amber signal light 34 has yellow LEDs 33 arranged in a triangle shape (i.e. caution sign shape). Green signal light 36 has green LEDs 35 arranged in a circular shape. The preferred embodiment is a single lens traffic light 40 having a housing 49 that provides at least three signal lights 42, 44, and 46. The three signal lights 42, 44, and 46 are all embedded in a single opening 50 of housing 49. The LEDs for signal lights 42, 44, and 46 are arranged in a generally common area that allows activation and display of one of the signal lights in a corresponding symbolic shape (i.e. universal symbol or words). Red signal light 42 has red LEDs 41 spread out and arranged in an octagon shape (i.e. stop sign shape). Green signal light 46 has green LEDs 45 spread out and arranged in a circular shape. In the areas which red signal light 42 and green signal light 46 commonly overlap, clusters of two LEDs (i.e. red LEDs 41 and green LEDs 45) exist. Yellow signal light 44 has yellow LEDs 43 spread out and arranged mounted in a triangle shape. In the areas which the three signal lights 42, 44, and 46 commonly overlap, clusters of three LEDs (i.e. red LEDs 41, yellow LEDs 43, and green LEDs 45) exist. Also, the principle of the single lens traffic light is not limited to an LED construction but can also be made from other suitable and appropriate colored lights or light sources.

18 Claims, 4 Drawing Sheets

LED TRAFFIC LIGHT AND METHOD OF MANUFACTURE AND USE THEREOF

This Non-Provisional Application claims the benefit of U.S. Provisional Application Number 60/020,098 filed on Jun. 19, 1996.

BACKGROUND OF THE INVENTION

1. Fields of Invention

The present invention relates to a traffic light invention, and, more particularly, relates to a Light Emitting Diode (LED) traffic light apparatus and corresponding methods of manufacture and use thereof.

2. Discussion Of Background And Prior Art

The typical conventional traffic light has a heavy housing unit which holds a vertical or horizontal arrangement of at least three different round signal lights each having a corresponding lens (See FIG. 1—Prior Art). The three round lights are a red signal light which represents "Stop", a yellow signal light which represents "Caution", and a green signal light which represents "Go". A red arrow signal light and/or a green arrow signal light, which are used for controlling protected turns, can also be added to the arrangement. In the conventional arrangement, the red signal light is produced by using an incandescent bulb (i.e. typically 67 to 150 watts) and a red filter. Similarly, the yellow signal light is produced by using an incandescent bulb and a yellow filter, and the green signal light is produced by using an incandescent bulb and a green filter. Furthermore, the red arrow signal light is produced by using an incandescent bulb and a filter that produces a red arrow, and the green arrow signal light is produced by using an incandescent bulb and a filter that produces a green arrow.

Each incandescent lamp (i.e. single round light or single arrow light) used in the typical traffic light consumes a fair amount of power (i.e. about sixty seven (67) to one hundred fifty (150) watts) in relative to a number of other types of light bulbs or light sources. Incandescent lamps have the disadvantage of producing a lot of heat when they are being used, and they do not produce useful light efficiently (i.e. only a small amount of light produced by incandescent lamps is in the visible spectrum). For example, only the red light of the incandescent lamp passes through the red filter lens and is used to provide the red signal light for a traffic light. Therefore, a lot of energy is wasted in producing the rest of the light and heat.

Furthermore, the incandescent lamps burn out and have to be replaced periodically (i.e. at least annually to conform with the National Traffic Safety Board regulations). Since the replacement of the bulbs for the incandescent lamps has to be done on site (i.e. at the intersection), a crew is usually necessary to perform this task. Therefore, the costs of replacing the incandescent lamp parts themselves and the personnel and labor required to perform these replacing services add to the costs of using and maintaining incandescent lamps for traffic lights.

Therefore, Light Emitting Diodes (LEDs) are being experimented with and used to replace incandescent lamps for traffic lights (See disclosure in *Tech Update* by E Source, November 1995, pp. 1–16 and Chapter 13 of E Source Publication, Secs. 13.1 to 13.2.2, 1994). The LED traffic light would also include the vertical or horizontal arrangement of at least three round signal lights (i.e. red, yellow, green) and can also include the protected turn signal (i.e. red arrow, green arrow) (See FIG. 2—Prior Art). Each of the signal lights includes a number of LEDs closely arranged together in the desired round or arrow pattern. The LED traffic light provides the advantages of generally consuming less power (i.e. single round light or single arrow light consumes about nine (9) to twenty five (25) watts of power), of producing at least red light (i.e. red signal light) more efficiently and very cost effectively, and of not burning out as often as an incandescent light. However, red light producing LEDs are designed only to provide red light, and they cannot be filtered to produce other colors.

LEDs can be changed to produce other colors by changing the ratios of various trace elements. Thus, yellow (amber) and green LEDs are available. Furthermore, the conventional traffic light design has been used for the LED traffic light (i.e. at least three different round signal lights each having a lens), and therefore, the typical heavy and bulky housing is still used to hold the round or arrow patterned LED traffic signal lights. Therefore, the costs and problems associated with providing, mounting, and maintaining the typical housing still exist. Heavy duty equipment (i.e. cables or poles) is still needed to hold and maintain the LED traffic light, and necessary personnel are needed to mount the LED traffic light.

Furthermore, the conventional LED traffic light still has the problem of allowing a driver or pedestrian to distinguish one light from the other only by its position on the three (3) light array. This problem is especially evident for persons that are color blind who may not be able to easily distinguish one color light from the other.

Therefore, an LED traffic light invention that is overall more efficient and cost effective, that has a less bulky, less expensive, and easy to mount housing unit, and that is designed so that each of the lights is more easily distinguishable is needed and desired, and it is an object of the present invention to overcome the problems and limitations of the prior art that has been discussed.

SUMMARY OF THE INVENTION

Set forth is a brief summary of the invention in order to solve the foregoing problems and achieve the foregoing and other objects, benefits, and advantages in accordance with the purposes of the present invention as embodied and broadly described herein.

Accordingly, it is an object and advantage of the present invention to provide an LED traffic light having a housing that holds at least three different signal lights wherein the signal lights are each embedded in an opening of the housing and the signal lights are made of LED lights that are arranged in symbolic shapes that further represent one of the traffic signals.

It is one aspect and advantage of the present invention to provide an LED traffic light having a housing that holds at least three different signal lights wherein the signal lights have LED lights that are arranged in the shapes of universal symbols.

It is another aspect and advantage of the present invention to provide an LED traffic light having a housing that holds at least three different signal lights wherein the red signal light is formed by arranging and mounting red LEDs in the universal stop sign shape (i.e. octagon).

It is another aspect and advantage of the present invention to provide an LED traffic light having a housing that holds at least three different signal lights wherein the yellow or amber signal light is formed by arranging and mounting yellow LEDs in the universal caution sign shape (i.e. triangle).

It is another aspect and advantage of the present invention to provide an LED traffic light having a housing that holds at least three different signal lights wherein the green signal light is formed by arranging and mounting green LEDs in a round shape.

It is a further object and advantage of the present invention to provide a method of making an LED traffic light by providing a housing that holds at least three different signal lights, embedding each signal light in an opening of the housing, and arranging the LED lights of each signal light in a symbolic shape that further represents the corresponding traffic signal.

It is a further object and advantage of the present invention to provide a method of using an LED traffic light having a housing that holds at least three different signal lights by mounting the traffic light at a desired location, coupling the traffic light to a power source, attaching the traffic light to a switch box that controls operation of the traffic light, and activating and controlling each light signal in its corresponding symbolic shape at the appropriate times by using the switch box.

Accordingly, it is an object and advantage of the present invention to provide a single lens LED traffic light having a housing that provides at least three signal lights wherein three signal lights are all embedded in a single opening of the housing and the single opening is covered by a single lens and the signal lights are formed by arranging LEDs in a generally common area of the circuit board that is mounted into the single opening to allow the activation and display of one of the signal lights in a corresponding symbolic shape.

It is one aspect and advantage of the present invention to provide a single lens LED traffic light wherein the signal lights have LED lights that are arranged in the shapes of universal symbols.

It is another aspect and advantage of the present invention to provide a single lens LED traffic light wherein the signal lights have LED lights that are arranged in the form of words.

It is another aspect and advantage of the present invention to provide a single lens LED traffic light wherein the red signal light is formed by arranging and mounting red LEDs in the universal stop sign shape (i.e. octagon).

It is another aspect and advantage of the present invention to provide a single lens LED traffic light wherein the yellow or amber signal light is formed by arranging and mounting yellow LEDs in the universal caution sign shape (i.e. triangle).

It is another aspect and advantage of the present invention to provide a single lens LED traffic light wherein the green signal light is formed by arranging and mounting green LEDs in a round shape.

It is a further aspect and advantage of the present invention to provide a single lens LED traffic light wherein clusters of two LEDs are formed in the areas commonly shared by the red signal light and the green signal light.

It is a further aspect and advantage of the present invention to provide a single lens LED traffic light wherein clusters of three LEDs are formed in the areas commonly shared by the red signal light, the yellow signal light, and the green signal light.

It is a further object and advantage of the present invention to provide a method of making a single lens LED traffic light by providing a housing having a single opening, embedding the signal lights in the single opening of the housing, and arranging the LED lights in a generally common area of a circuit board that is embedded in the single opening so that each signal light is in a symbolic shape that further represents the corresponding traffic signal.

It is a further object and advantage of the present invention to provide a method of using a single lens LED traffic light that has a housing with a single opening by mounting the single lens traffic light at a desired location, coupling the single lens traffic light to a power source, attaching the single lens traffic light to a switch box that controls operation of the traffic light, and activating each light signal by controlling only the corresponding LEDs for that light signal in its corresponding symbolic shape at the appropriate times by using the switch box.

It is a further object and advantage of the present invention to provide a method of making a single lens traffic light by providing a housing having a single opening, embedding the signal lights in the single opening of the housing, and arranging the light sources for the signal lights in a generally common area of a circuit board that is embedded in the single opening so that each signal light is in a symbolic shape that further represents the corresponding traffic signal.

It is an object and advantage of the present invention to provide a single lens LED traffic light that is smaller and lighter and less hazardous and is much easier and less expensive to mount and maintain.

It is an object and advantage of the present invention to provide a traffic light wherein each of the signal lights is more easily distinguishable to the viewer, especially to a color blind person.

DETAILED DESCRIPTION OF THE PREFERRED EMBODIMENT

Figure 1:
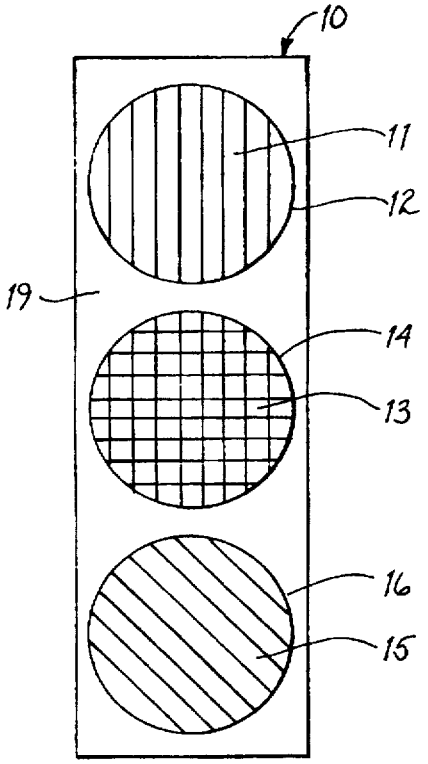
FIG. 1 (PRIOR ART)
FIG. 1 Front view of a prior art conventional traffic light showing three round signal lights.

The present invention generally discloses a uniquely designed and constructed LED traffic light 30 or 40 and method of manufacturing and using the LED traffic light 30 or 40. FIG. 1 shows a conventional traffic light 10 that utilizes incandescent lamps which is in the prior art. As stated earlier, the conventional traffic light 10 has a heavy housing 19 and three different round signal lights (i.e. red signal light 12 that uses a red filter 11, yellow or amber signal light 14 that uses a yellow filter 13, and green signal light 16 that uses a green filter 15). However, the conventional traffic light 10 has the disadvantages of consuming a fair amount of power, producing heat when being used, and wasting and not producing the desired color light efficiently.

Figure 2:
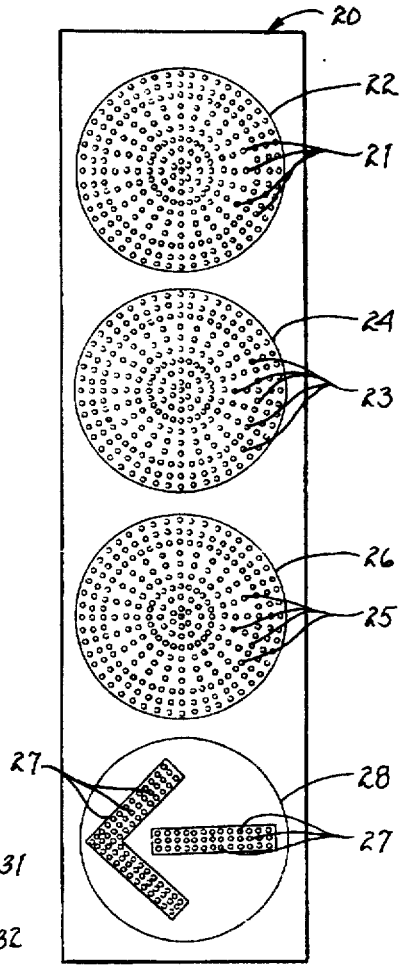
FIG. 2 (PRIOR ART)
FIG. 2 Front view of a prior art Light Emitting Diode (LED) conventional traffic light showing three round signal lights and one arrow signal light wherein each signal light has an individual lens.
Figure 11:
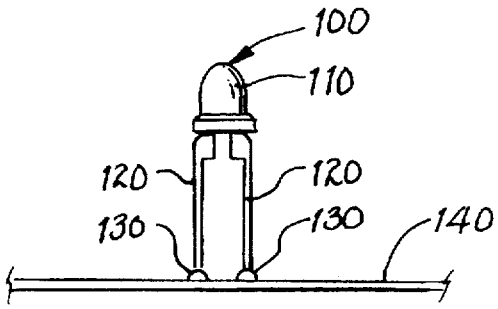
FIG. 11 Side view of a light emitting diode (LED) mounted to a circuit board that can be coupled to a power source and switch(es) that control the activation and deactivation of the LED.

FIG. 2 shows a Light Emitting Diode (LED) conventional traffic light 20. As stated earlier, Light Emitting Diodes (LEDs) have been used to replace incandescent lamps for the conventional traffic light. The conventional LED traffic light 20 also has a heavy housing 29 and three different signal lights in which each signal light includes a number of LEDs closely arranged together in the desired round or arrow pattern (i.e. red signal light 22 comprising a number of red LEDs 21 arranged in a circular pattern, yellow or amber signal light 24 comprising a number or yellow LEDs 23 arranged in a circular pattern, green signal light 26 comprising a number of green LEDs 25 arranged in a circular pattern, and green arrow signal light 28 comprising a number of green LEDs 27 arranged in an arrow pattern). The LED lights for each signal light are mounted or soldered onto a circuit board, and the circuit board is coupled to a power source and switches that control the activation and deactivation of various lights. FIG. 11 shows a typical LED 100 having a light producing element 110 and terminals 120 which are mounted and soldered at joints 130 to circuit board 140.

The conventional LED traffic light 20 provides the advantages of consuming less power, producing red light (i.e. the red signal light 22) more efficiently and cost effectively, and not burning out as often as an incandescent lamp. The conventional LED traffic light 20 has the disadvantages of having a heavy and bulky housing 29 to hold the traffic signal lights 22, 24, 26, and 28, and therefore, the costs, problems, and hazards associated with providing, mounting, and maintaining the heavy housing 29 still exist. Furthermore, the conventional incandescent traffic light 10 or conventional LED traffic light 20 has the problem of not allowing a person (i.e. including but not limited to a driver or pedestrian) to easily distinguish one light from the other, especially for those persons who are color blind.

Figure 3:
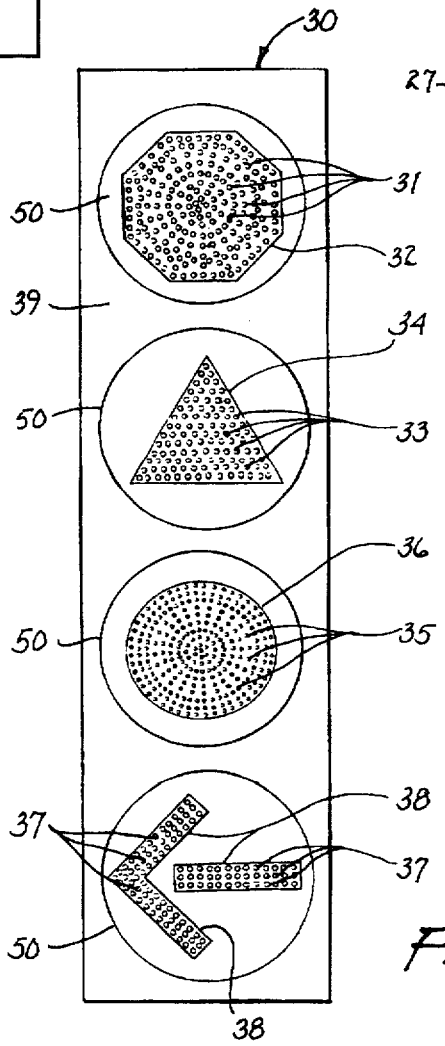
FIG. 3 Front view of a first embodiment of the present invention Light Emitting Diode (LED) traffic light showing four different signal lights wherein each signal light has an individual lens and is arranged in a symbolic shape that further represents one of the traffic signals.
Figure 13:
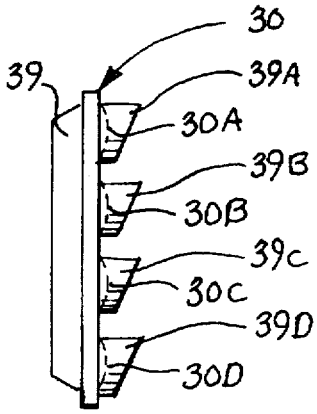
FIG. 13 Side view of the first embodiment of the present invention LED traffic light as shown in FIG. 3.

FIGS. 3 and 13 show an LED traffic light 30 of the present invention. Traffic light 30 is similar to the conventional LED traffic light 20. The LED traffic light 30 has a housing 39 that holds four different signal lights 32, 34, 36, and 38. The four signal lights 32, 34, 36, and 38 are each embedded in an opening 50 of housing 39. In FIG. 13, the signal lights 32, 34, 36, and 38 respectively have individual lens 30A, 30B, 30C, and 30D, and the individual lens 30A, 30B, 30C, and 30D are each respectively covered by lens enclosures 39A, 39B, 39C, and 39D as shown in FIG. 13 in which the lens enclosures direct the signal light towards viewers (i.e. including but not limited to persons on the street or ground surface). The LED lights for each signal light for traffic light 30 are also mounted or soldered onto a circuit board in the same manner as traffic light 20 (i.e. see FIG. 11), and the LED lights are also activated and controlled by a power source and switch(es). To provide reflectivity of the signal lights, the LED lights are mounted in reflective metal cells that are set into the rear of each opening 50 of housing 39.

The main differences between LED traffic light 30 and traffic light 20 are that the LEDs for traffic signal lights 32, 34, and 36 of traffic light 30 are mounted in the similar manner as in traffic light 20 (i.e. see FIG. 11) but are not arranged in the conventional round or circular shape as in traffic light 20 but instead are arranged in symbolic shapes (i.e. including but not limited to universal symbols) that further represent one of the traffic signals. In FIG. 3, the red signal light 32 includes red LEDs 31 arranged and mounted to a circuit board in an octagon shape (i.e. universal stop sign shape), and the yellow or amber signal light 34 includes yellow LEDs 33 arranged and mounted to a circuit board in a triangle shape (i.e. universal caution sign shape). The green signal light 36 includes green LEDs 35 arranged and mounted to a circuit board in a circular shape. A green arrow signal light 38 that includes green LEDs 37 arranged and mounted to a circuit board in an arrow signal shape is also made part of the LED traffic light 30.

Figure 12:
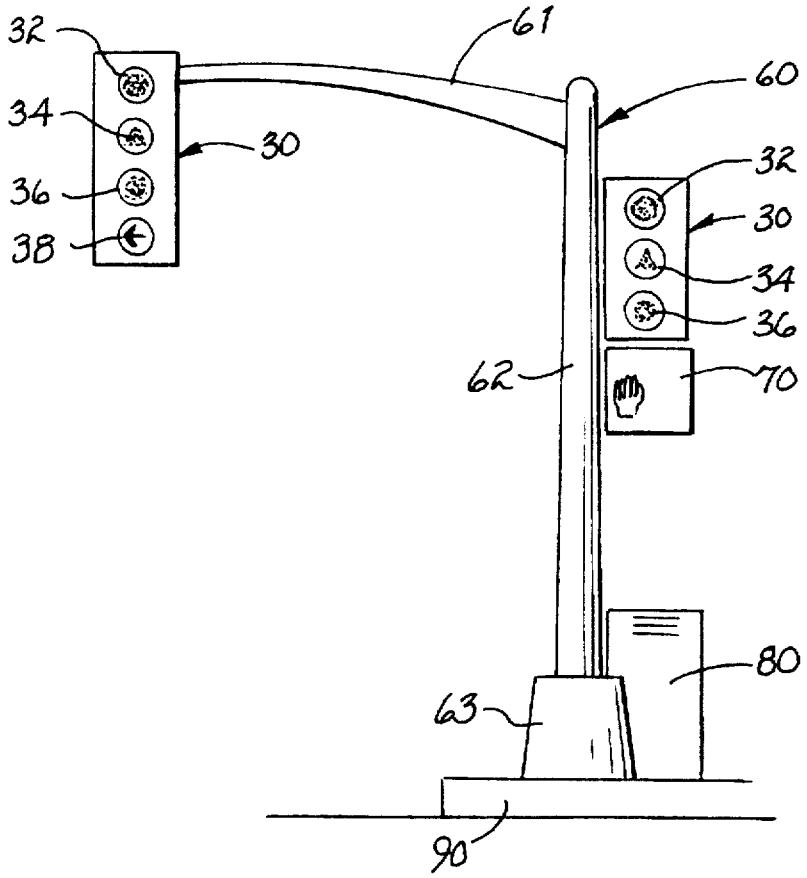
FIG. 12 Front view of two first embodiment LED traffic lights (i.e. the traffic light as shown in FIG. 3) mounted to a street post wherein one of the lights hangs generally above and in the middle of the street intersection while the other light is mounted to the post generally above the concrete surface (i.e. sidewalk) that is next to the street surface.

FIG. 12 shows the traffic light 30 mounted to a street post 60. The street post 60 includes a vertical pole structure 62 that is attached to a base 63 (i.e. concrete base), and the base 63 is fixed to a cement or concrete surface (i.e. sidewalk surface). A horizontal pole structure 61 appends perpendicularly from the vertical pole structure 62. An LED traffic light 30 is mounted generally at the end of the horizontal pole structure 61 so that the traffic light 30 hangs generally above and in the middle of the intersection. In FIG. 12, another LED traffic light 30 is mounted to the vertical pole structure 62 so that it generally hangs above the concrete (i.e. sidewalk) surface that is next to the street surface. A pedestrian signal light 70 is shown mounted to the vertical pole structure 62 below the second LED traffic light 30. The traffic lights 30 are attached to a power source and controlled by the switch box 80 located near the base 63. A light signal in its corresponding symbolic shape is activated at the appropriate times via the control of the programmed switch box 80.

Figure 10:
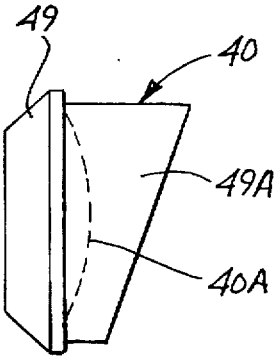
FIG. 10 Side view of the second and preferred embodiment of the present invention LED traffic light as shown in FIG. 5.

FIGS. 4–10 show an LED traffic light 40 that is the second embodiment and preferred embodiment of the present invention. The LED traffic light 40 has a housing 49 that provides at least three signal lights 42, 44, and 46. The three signal lights 42, 44, and 46 are all embedded in a single opening 50 of housing 49, and the single opening 50 is covered by a single lens 40A as shown in FIG. 10. The housing 49 is made of typical formed steel or any other suitable material having a highly reflective inside surface. The housing 49 can be made, round, rectangular, square, or any other suitable shape, and it does not have any penetrations except for the wires that are attached to the light emitting diodes (LEDs). The outer rim of the opening 50 of housing 49 allows the lens 40A to be fixed over the opening 50 with a flexible sealing ring to prevent moisture, debris, etc. from entering the housing 49 (i.e. as shown in FIG. 10). The lens 40A is different from the conventional "light collecting" lens in that it is larger (i.e. fifteen (15) to eighteen (18) inches in diameter) than the conventional lens, and the lens 40A is designed not only to collect light but to focus it to obtain maximum projection from the opening 50 towards a viewer. This maximum projection can be achieved in many different ways, and in this specific embodiment, it is achieved by using four sided, pyramid-like projections into the light chamber that collect light from all angles and focus the light from the opening 50 and forward to a viewer.

The single lens 40A is in turn shielded by a lens enclosure 49A as shown in FIG. 10 in which the lens shield 49A protects the signal light from ambient light, providing for better, high contrast visibility. The LED lights for each signal light for traffic light 40 are also mounted or soldered onto a circuit board in the similar manner as traffic light 20, and the LED lights are also activated and controlled by a power source and switch(es). To provide reflectivity of the signal lights, the LED lights are mounted in reflective metal cells that are set into the rear of the opening 50 of housing 49.

Figure 4:
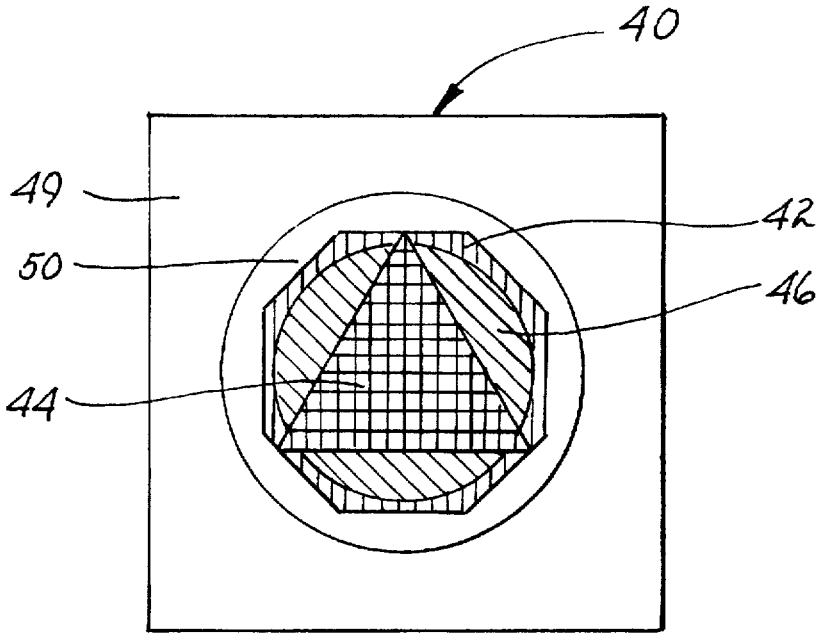
FIG. 4 Front view of a second and preferred embodiment of the present invention Light Emitting Diode (LED) traffic light having a single lens that is able to display one of the three signal lights (i.e. red, yellow, or green) within the single lens area wherein each signal light is arranged in a symbolic shape that further represents one of the traffic signals.

The LED traffic light 40, however, provides a single lens traffic light instead of a traffic light with multiple number of lenses. The housing 49 is much smaller and lighter than the conventional traffic light 20 or 30, and the traffic light 40 is much easier and less expensive to mount and maintain. Therefore, the overall costs for the purchase, operation, and maintenance of the LED traffic light 40 is less than the conventional traffic lights 20 or 30. Furthermore, the LEDs for traffic signal lights 42, 44, and 46 are mounted to a single circuit board in the similar manner as shown in FIG. 11. FIG. 4 shows that the LED traffic light 40 can be activated to one of the traffic signal light colors.

Figure 5:
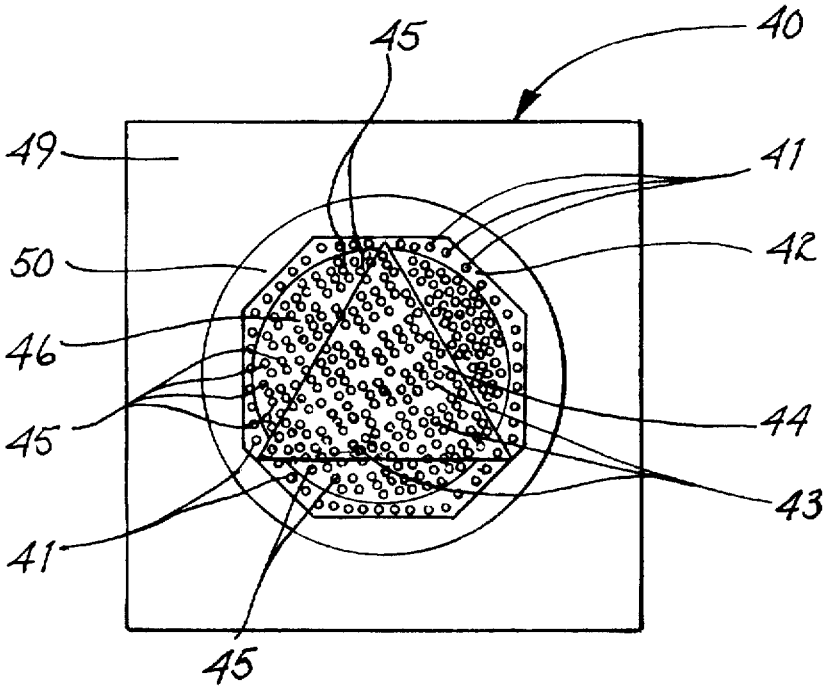
FIG. 5 Front view of the second and preferred embodiment of the present invention LED traffic light of FIG. 4 clearly showing the LED lights for each of the three signal lights.

FIG. 5 shows that the LEDs are arranged in a generally common area of the circuit board to allow the activation and display of one of the signal lights in a corresponding symbolic shape (i.e. including but not limited to universal symbols). In FIG. 5, the red signal light 42 occupies the largest area, and it includes red LEDs 41 spread out, arranged, and mounted to a circuit board in an octagon shape (i.e. universal stop sign shape). The green signal light 46 occupies the second largest area, and it includes green LEDs 45 spread out, arranged, and mounted to the circuit board in a circular shape. In those areas in which the red signal light 42 and the green signal light 46 commonly overlap, clusters of two LEDs (i.e. red LEDs 41 and green LEDs 45) exist. Furthermore, in FIG. 5, the yellow signal light 44 occupies the least area, and it includes yellow LEDs 43 spread out, arranged, and mounted to the circuit board in a triangle shape (i.e. universal caution sign shape). In those areas in which the red signal light 42, the yellow signal light 44, and the green signal light 46 commonly overlap, clusters (i.e. overlap) of three LEDs (i.e. red LEDs 41, yellow LEDs 43, and green LEDs 45) exist.

Figure 6:
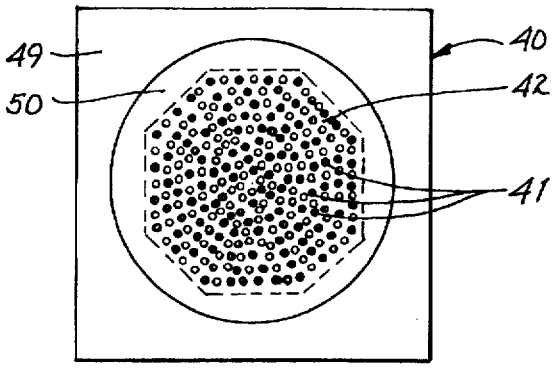
FIG. 6 Front view of the second and preferred embodiment of the present invention LED traffic light of FIG. 5 clearly showing the illumination of the red signal light in the arrangement of a octagon (i.e. stop sign shape).
Figure 7:
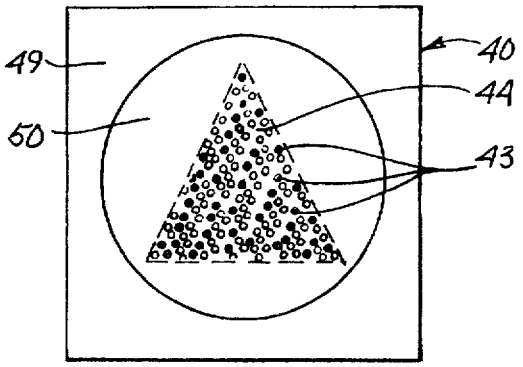
FIG. 7 Front view of the second and preferred embodiment of the present invention LED traffic light of FIG. 5 clearly showing the illumination of the yellow signal light in the arrangement of a triangle (i.e. caution sign shape).
Figure 8:
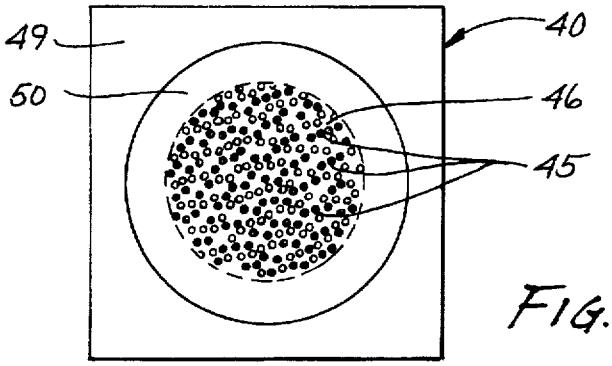
FIG. 8 Front view of the second and preferred embodiment of the present invention LED traffic light of FIG. 5 clearly showing the illumination of the green signal light in the arrangement of a circle.

The LED lights for traffic light 40 are mounted or soldered onto the circuit board in the similar manner as shown in FIG. 11, and the LED lights are also activated and controlled by a power source and switch(es). FIG. 6 shows that when the red signal light 42 is activated, only the red LEDs 41 (i.e. either individually or within the clusters) light up in the octagon shape (i.e. stop sign shape). FIG. 7 shows that when the yellow or amber signal light 44 is activated, only the yellow LEDs 43 (i.e. either individually or within the clusters) light up in the triangle shape (i.e. caution sign shape). FIG. 8 shows that when the green signal light 46 is activated, only the green LEDs 45 (i.e. either individually or within the clusters) light up in the circular shape. The activation of the traffic signal lights are controlled by switch (es) (i.e. including but not limited to programmed switch (es).

Figure 9:
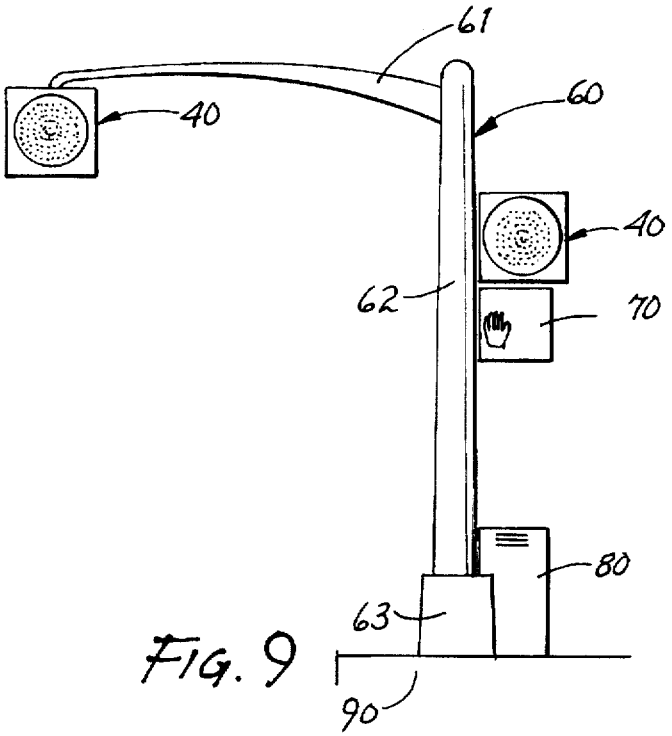
FIG. 9 Front view of two second and preferred embodiment LED traffic lights (i.e. the traffic light as shown in FIG. 5) mounted to a street post wherein one of the lights hangs generally in the middle of the street intersection while the other light is mounted to the post generally at a side of the street.

FIG. 9 shows the traffic light 40 mounted to a street post 60. The street post 60 includes a vertical pole structure 62 that is attached to a base 63 (i.e. concrete base), and the base 63 is fixed to a cement or concrete surface (i.e. sidewalk surface). A horizontal pole structure 61 appends perpendicularly from the vertical pole structure 62. An LED traffic light 40 is mounted generally at the end of the horizontal pole structure 61 so that the traffic light 40 hangs generally above and in the middle of the intersection. In FIG. 9, another LED traffic light 30 is mounted to the vertical pole structure 62 so that it generally hangs above the concrete (i.e. sidewalk) surface that is next to the street surface. A pedestrian signal light 70 is shown mounted to the vertical pole structure 62 below the second LED traffic light 40. The traffic lights 40 are attached to a power source and controlled by the switch box 80 located near the base 63. A light signal in its corresponding symbolic shape is activated at the appropriate times via the control of the programmed switch box 80.

Alternatively, the traffic signal 40 can be rectangular, round, square, or any other suitable shape having a single lens, but the LEDs can be arranged in a common area in the shapes of letters that spell the word "STOP" for the red LEDs, the word "GO" for the green LEDs, and the yellow or amber light can be made solid or in the shape of several triangles by using the yellow LEDs.

The principles of the present invention of providing a single lens traffic light instead of a multiple lens traffic light are not limited to LEDs, but other types of suitable lights or light sources which are able to provide the appropriate colored lights can be arranged, activated, and used in the same or similar manner.

The LED traffic light of the present invention provides the advantages of being smaller, lighter, and less hazardous and is much easier and less expensive to mount and maintain. It is also designed so that each of the signal lights is more easily distinguishable to the viewer, especially to a color blind person.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable other skilled in the art to best utilize the invention in various embodiments and with various modifications as are suited to the particular use contemplated.

What is claimed is:

1. A traffic light apparatus comprising:

a housing having at least one opening, and at least three signal lights embedded into the at least one opening of the housing wherein each of the at least three signal lights are light emitting diodes arranged in a symbolic shape that is representative of one of the at least three signal light.

2.The traffic light apparatus according to claim 1 wherein the at least one opening is at least three separate openings and wherein each of the at least three signal lights is correspondingly embedded into one of the at least three separate openings and each of the at least three signal lights comprises light emitting diodes that are arranged in the symbolic shape of a universal symbol.

3. The traffic light apparatus according to claim 2 wherein one of the at least three separate openings holds a red signal light formed by arranging and mounting red light emitting diodes in a universal stop sign shape.

4. The traffic light apparatus according to claim 2 wherein one of the at least three separate openings holds a yellow signal light formed by arranging and mounting yellow light emitting diodes in a universal caution sign shape.

5. The traffic light apparatus according to claim 2 wherein one of the at least three separate openings holds a green signal light formed by arranging and mounting green light emitting diodes in a universal proceed sign shape.

6. The traffic light apparatus according to claim 1 wherein the at least one opening is one single opening and wherein the at least three signal lights are embedded into the one single opening of the housing and the at least three signal lights are formed by arranging the light emitting diodes in a generally common area of a circuit board mounted into the one single opening to allow activation and display of one of the signal lights in a symbolic shape of a universal symbol.

7. The traffic light apparatus according to claim 6 wherein one of the at least three signal lights is a red signal light formed by arranging and mounting red light emitting diodes in a universal stop sign shape.

8. The traffic light apparatus according to claim 6 wherein one of the at least three signal lights is a yellow signal light formed by arranging and mounting yellow light emitting diodes in a universal caution sign shape.

9. The traffic light apparatus according to claim 6 wherein one of the at least three signal lights is a green signal light formed by arranging and mounting green light emitting diodes in a universal proceed sign shape.

10. The traffic light apparatus according to claim 6 wherein some of the light emitting diodes are clustered together so that the at least three signal lights are located within a perimeter of the one single opening.

11. The traffic light apparatus according to claim 1 further comprising:

a lens placed over each of the at least one openings for collecting light from the ligth emitting diodes of each of the at least three signal lights and focusing the light towards a viewer.

12. The traffic light apparatus according to claim 1 further comprising:

a lens enclosure surrounding each of the at least one openings for directing light from the at least one opening towards a viewer.

13. A method of making a traffic light comprising the steps of:

providing a housing having at least one opening, and embedding at least three signal lights into the at least one opening of the housing wherein each of the at least three signal lights are light emitting diodes arranged in a symbolic shape that is representative of one of the at least three signal light.

14. The method of making a traffic light according to claim 13:

wherein the providing step further comprises the step of providing a housing having at least three separate openings, and wherein the method of making a traffic light further comprises the steps of correspondingly embedding each of the at least three signal lights into one of the at least three separate openings and arranging light emitting diodes in the symbolic shape of a universal symbol to provide each of the at least three signal lights.

15. The method of making a traffic light according to claim 13:

wherein the providing step further comprises the step of providing a housing having one single opening, and wherein the method of making a traffic light further comprises the steps of embedding the at least three signal lights into the one single opening of the housing and forming the at least three signal lights by arranging the light emitting diodes in a generally common area of a circuit board mounted into the one single opening to allow activation and display of one of the signal lights in a symbolic shape of a universal symbol.

16. A method of using a traffic light comprising the steps of:

providing a traffic light with a housing having at least one opening and at least three signal lights embedded into the at least one opening of the housing wherein each of the at least three signal lights are light emitting diodes arranged in a symbolic shape that is representative of one of the at least three signal lights, mounting the traffic light at a desired location, coupling the traffic light to a power source, attaching the traffic light to a control switch box to operate the traffic light, and controlling each of the at least three signal lights in its corresponding symbolic shape at appropriate times by using the control switch box.

17. The method of using a traffic light according to claim 16:

wherein the providing step further comprises the step of providing a traffic light with a housing having at least three separate openings.

18. The method of using a traffic light according to claim 16:

wherein the providing step further comprises the step of providing a traffic light with a housing having one single opening.

* * * * *